United States Patent [19]

Scragg et al.

[11] 4,311,441

[45] Jan. 19, 1982

[54] POSITIVE DISPLACEMENT DEVICE

[75] Inventors: Frederick Scragg; Michael L. Scragg, both of Trinity, Jersey; Peter Marshman, St. Brelade, Jersey, all of Channel Islands

[73] Assignee: Mantec Industries Limited, Channel Islands

[21] Appl. No.: 107,786

[22] Filed: Dec. 28, 1979

[30] Foreign Application Priority Data

Jan. 9, 1979 [GB] United Kingdom ..... 00810/79

[51] Int. Cl.[3] ..... F04B 43/00

[52] U.S. Cl. ..... 417/383; 417/474; 417/486

[58] Field of Search ..... 417/375, 383, 385, 388, 417/389, 474, 475, 347, 486

[56] References Cited

U.S. PATENT DOCUMENTS 2,926,614 3/1960 Rose, Jr. ..... 417/900 X
3,560,114 2/1971 Boyle ..... 417/474 X

FOREIGN PATENT DOCUMENTS 894503 10/1953 Fed. Rep. of Germany ..... 417/388
1937161 3/1970 Fed. Rep. of Germany ..... 417/475

*Primary Examiner*—Leonard E. Smith
*Attorney, Agent, or Firm*—Lewis H. Eslinger

[57] ABSTRACT

A fluid displacement device is described which may be used as a pump, a motor or a device such as a vibrator for concrete. It includes a body having at least three, and preferably four or five wall portions, which are disposed one after the other along the axis of the body, discrete chambers being formed behind each wall portion, which may, for example, be a toroidal diaphragm, means being provided to feed an operating fluid under pressure to the discrete chambers to move the wall portions transversely to the axis of the body in a sequence to cause displacement of an external fluid axially of the body. When used as a motor, movement of the external fluid axially of the body will cause displacement of the wall portions and thus flow of the operating fluid so that power may be derived therefrom.

9 Claims, 10 Drawing Figures

POSITIVE DISPLACEMENT DEVICE

DESCRIPTION

The present invention relates to fluid displacement devices.

Fluid displacement devices comprising piston and cylinder pumps and motors are well known. Another form of fluid displacement device, which can be self-priming, is one employing the Moineau principle, that is having a stator with an internal helical gear form and a rotor rotatable within the stator and itself having a helical gear form having one more or one less start than the stator. Such devices are satisfactory, but they are limited in the pressure head which they can stand because the stator is usually made of a resilient material which will retract if the pressure head pumped or applied by the device is above a certain value. Furthermore, because at low head conditions there should be an interference fit between the rotor and the stator, the starting torque on the drive motor is very substantial.

Other forms of fluid displacement device have been proposed in the form of peristaltic pumps. These include a flexible tube or body having an axis, adjacent portions of the wall of the tube being sequentially movable transversely of the axis to effect displacement of the fluid. This is usually effected by rollers which squeeze the tube sequentially and push the fluid forwardly. Such devices are satisfactory for low pressure heads and for relatively low fluid flows and are used extensively in the medical field. However, they are not suitable for acting at high pressures or high flow rates and are generally rather inefficient.

It is now proposed, according to the present invention, to provide a pump which has some similarity to a peristaltic pump, but differs from such a pump in that it has at least three wall portions disposed one after the other along the axis, in that discrete chambers are formed behind each wall portion and in that means are provided to feed an operating fluid under pressure to, or to receive operating fluid under pressure from, said discrete chambers to move said wall portions transversely to the axis of the body in a sequence to cause displacement of an external fluid axially of the body, or to enable power to be derived from the operating fluid as a result of an external fluid moving axially of the body in contact with said wall portions.

The term "operating fluid" is used in this Specification to mean the fluid which is used to operate the wall portions, when the device is used as a pump and the term "external fluid" is the fluid which is pumped by the device. When the device is used as a motor the "external fluid" is that derived from an external source, while the operating fluid is again the fluid behind the wall portions.

Such a construction can be made relatively simply and inexpensively and need not have any rotating parts at all. It will be capable of pumping a very substantial head limited solely by the pressure which can be applied behind each wall portion and by the strength of the wall portion itself.

Furthermore, the construction could be used as a motor, which would not be possible with a peristaltic pump. A further use of the device would be as a vibrator in material such as concrete.

Advantageously, the body has a passage therethrough with an opening at each end, the wall portion being movable transversely of the axis of the passage to close off the passage at the axial location in the passage of the respective wall portion.

The set up can take a number of different forms and it is contemplated that the wall could take the form of four rectangular cross-section pistons arranged at right angles to one another and dividing the passage from the chambers therebehind, the pistons when they move to an inner position closing off the passage. However, such a construction is relatively cumbersome and it is preferred to use flexible diaphragms as the wall portions. These diaphragms may be arranged to be mounted on the body or on an inner member passing through a passage in the body.

Thus, the body may comprise an outer member having the passage therethrough with openings at each end, the inner member extending axially through said passage, and at least three wall portions are mounted on the outer member and are each movable separately of the others transversely of the axis to close off the passage at the axial location in the passage of the respective wall portion.

In an alternative arrangement, the body comprises an outer body member having a passage therethrough with an opening at each end and an inner member extending into said passage, and said at least three wall portions are formed on said inner member and are each movable separately of the others transversely of the axis of the passage to close off the passage at the axial location in the passage of the respective wall portion.

This is the presently preferred arrangement and can be made in a relatively simple manner. The outer member can simply be a pipe, preferably of circular cross-section, and the inner member can be of circular cross-section core with at least three, and preferably four or five toroidal diaphragms mounted at axially adjacent locations, the interior of the diaphragms communicating with a bore or interior chamber in the core, whereby the operating fluid can be applied to, or removed from, the chambers formed within the toroidal diaphragms.

The diaphragms are advantageously constructed of a material, such as neoprene rubber, which is provided with a plurality of circumferentially spaced flexible reinforcing elements which each extend around the torus and lie substantially within planes including the axis of the torus. Although these reinforcing elements may be in planes inclined slightly to the axis, this inclination should not be too great. The effect of the reinforcing elements is to allow for the rate of expansion of the torus, but to prevent any elongation in the axial direction of the torus. Thus the toroidal diaphragms can withstand a very high internal pressure.

Other reinforcing elements may be applied transverse to these reinforcing elements, but these are not essential.

As mentioned, the outer member can simply be a pipe and the core with its toroidal diaphragms can be inserted into the pipe and be used, for example, as a bore hole pump.

Now the means for feeding operating fluid under pressure to, or receiving operating fluid under pressure from, the chambers, may take many forms. For example, an external source of pressure and suction could be provided and a cyclically operating valving arrangement could cooperate with this to feed the fluid under pressure at the correct sequence to the various chambers.

In another arrangement, the core includes at least four compartments, each compartment being connected to the chamber with a separate one of the toroidal diaphragms and elements are provided within said compartment to expel fluid from the compartment into the chambers and vice versa. This arrangement can take many forms; for example, the compartments can be arranged in pairs, the compartments of a pair being axially aligned and a bellows being arranged to extend partly in one compartment and partly in the other, whereby expansion of the bellows in one compartment causes a contraction of the bellows in the other and vice versa.

In another arrangement, the compartments are in the form of a cylinder having a piston relatively axially reciprocable therein, one compartment being formed on each axial side of the piston, and an annular bag of flexible material filled with fluid under pressure is located between the facing longitudinally extending piston cylinder wall. Again reciprocation of the piston causes expulsion of the liquid from one compartment and drawing in of the liquid from the other.

However, in a presently preferred arrangement, the inner member is formed from a stack of diaphragm support plates, each plate having a number of apertures therein equal to the number of diaphragms, to form that number of fluid passages through the stack, the diaphragms being mounted to extend around the periphery of the adjacent support plates, ducts are provided between the chamber formed in each diaphragm and a separate one of the fluid passages. With this arrangement the means for feeding fluid under pressure can comprise pistons axially reciprocable in axial extensions of the fluid passages, the pistons being driven, for example, by a swash plate.

Advantageously an annular reservoir is disposed around the fluid passages at a location between the piston and the nearest diaphragm, the annular reservoir including an annular external diaphragm subjected to the high pressure side of the pump or motor. The annular external diaphragm should be of sufficient stiffness or resilience, to enable all of the toroidal diaphragms to be fully expanded, upon the drive being stopped. With this arrangement, should the motor be shut off, then the fluid pressure acting on the exterior of the reservoir diaphragm will be communicated to the operating fluid within the fluid passages and thus within the toroidal diaphragms, so that there will be no tendency for the diaphragms to collapse and allow the fluid head to discharge through the pump; this will stop the device acting as a motor. A protective grill preferably surrounds the reservoir and a resilient band may be located within it and communicates with the pressure within the fluid passages whereby the band can act as a valve, which may be supported by a perforated support grid therewithin. The valve band has such a stiffness to keep the valve closed during normal pumping. However, the band is capable of expanding suddenly to allow the operating fluid back into the reservoir upon restarting of the motor. Small apertures are provided in the valve band to allow the fluid to flow from the reservoir to the diaphragms when the motor is stopped.

In order that the present invention may more readily be understood, the following description is given, merely by way of example, reference being made to the accompanying drawings which illustrate a presently preferred embodiment of fluid displacement device according to the present invention.

Figure 1:
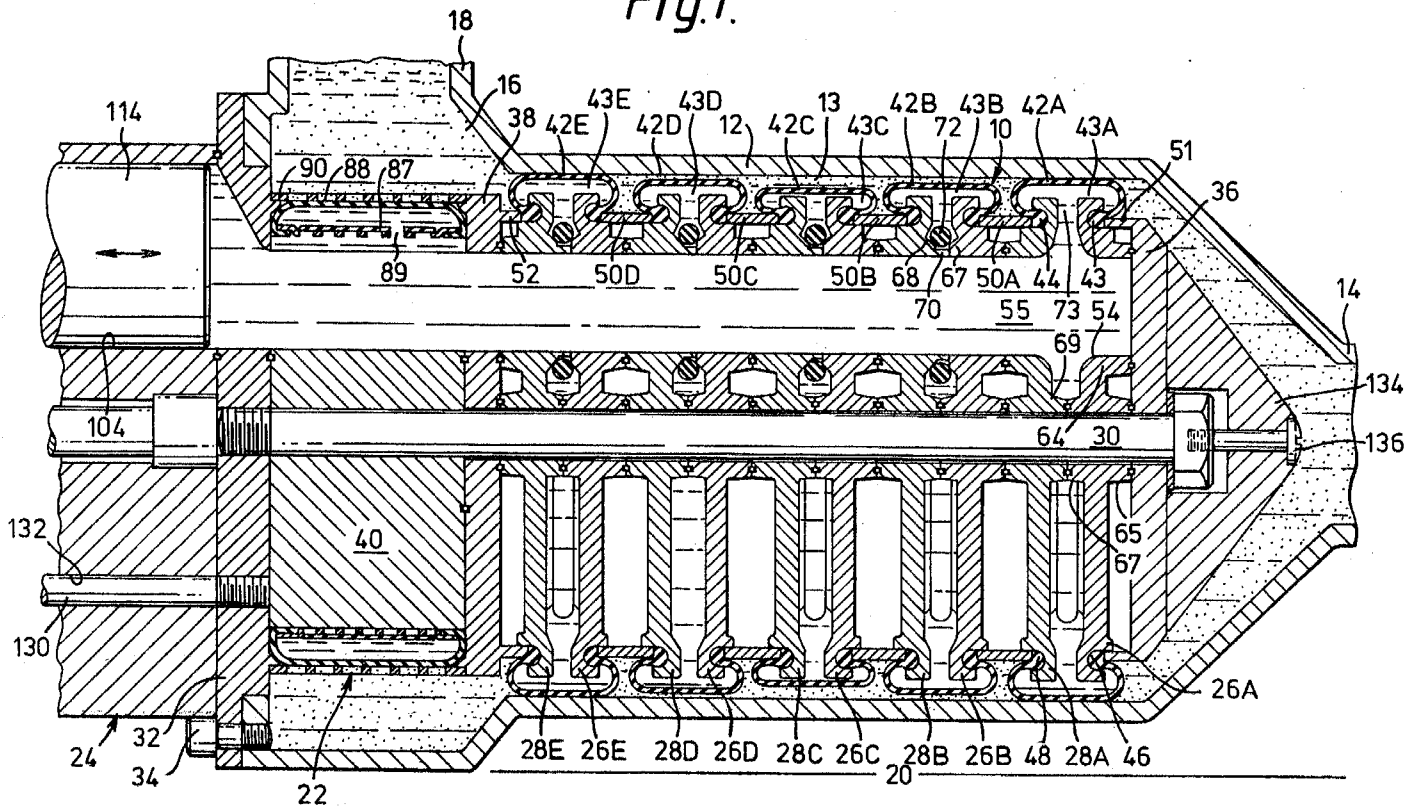
FIG. 1 is a cross-section through the body face section, the interface unit and part of the pressurizing section of the device.

Referring first to FIG. 1, the fluid displacement device is indicated by the general reference numeral 10 and is shown as enclosed in a casing 12, forming a passage 13, which has an inlet 14 at its righthand end, and an annular outlet chamber at its lefthand end, this outlet chamber being provided with an outlet duct 18.

The device can be considered to consist of three parts, firstly an inner member 20, secondly an interface unit 22 and thirdly a pressurizing section 24.

Discussing first the construction of the inner member, this comprises five first diaphragm support plates 26A, 26B, 26C, 26D, 26E and five second diaphragm support plates 28A, 28B, 28C, 28D, 28E all assembled in a stack and held together by an assembly bolt 30 which is screwed into a bulkhead 32 which in turn is secured to the casing 12 by a number of bolts, one of which is indicated by the reference numeral 34. The bolt also secures an inlet end plate 36 and an outlet end plate 38 which are located at the inlet and outlet end of the stacks of diaphragm support plates. Furthermore, an interface unit core 40 is clamped by the bolt between the bulkhead 32 and the outlet end plate 38.

Five toroidal diaphragms 42A, 42B, 42C, 42D and 42E are clamped by means of edge thickened beads 43 and 44 in annular grooves 46 and 48 formed in the first and second diaphragm support plates respectively. The clamping is effected during the bolting up of the stack of plates and the action is completed by four clamp rings 50A, 50B, 50C, 50D located between the adjacent second and first diaphragm support plates in sequence, and by inlet and outlet end plate clamp rings 51 and 52 formed on the inlet and outlet end plate 36 and 38.

Formed in each of the diaphragm support plates are five equi-angularly spaced apertures 54,56,58,60 and 62 which are assembled in register with one another and form five fluid passages, only one of which can be seen in the drawing and this is indicated by the reference numeral 55. A central aperture 63 is formed in each of the diaphragm support plates, the inlet and outlet end plates, and the interface unit core.

Figure 2:
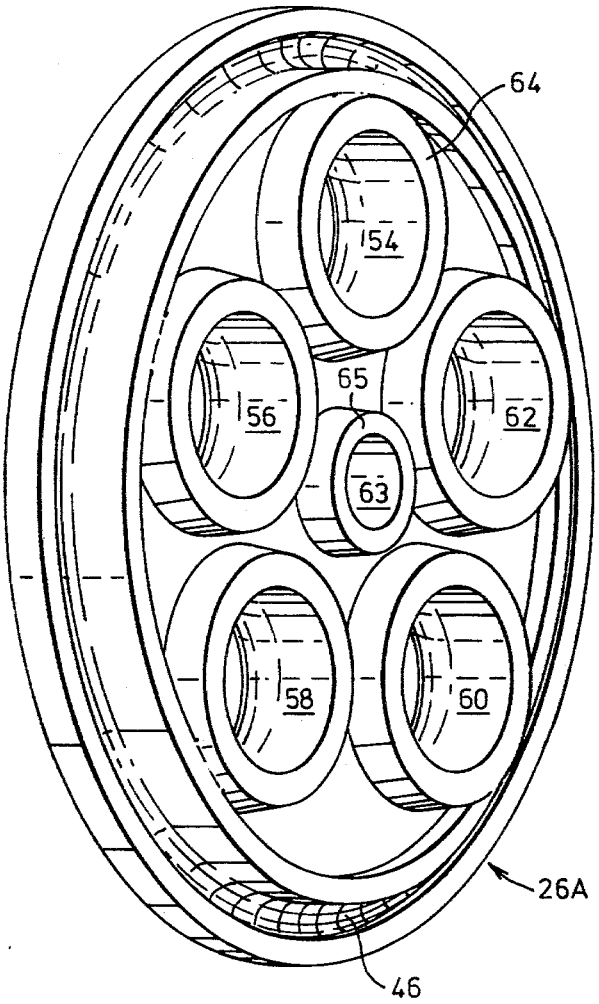
FIG. 2 is a perspective view from the right of the righthand-most first diaphragm support plate.

It will be seen from FIG. 1 and FIG. 2 that the righthand face of the righthand-most first diaphragm support plate 26A has an upstanding boss 64 surrounding each of the apertures 54 to 62 and a further upstanding boss 65 surrounding the central apertures 63.

Figure 3:
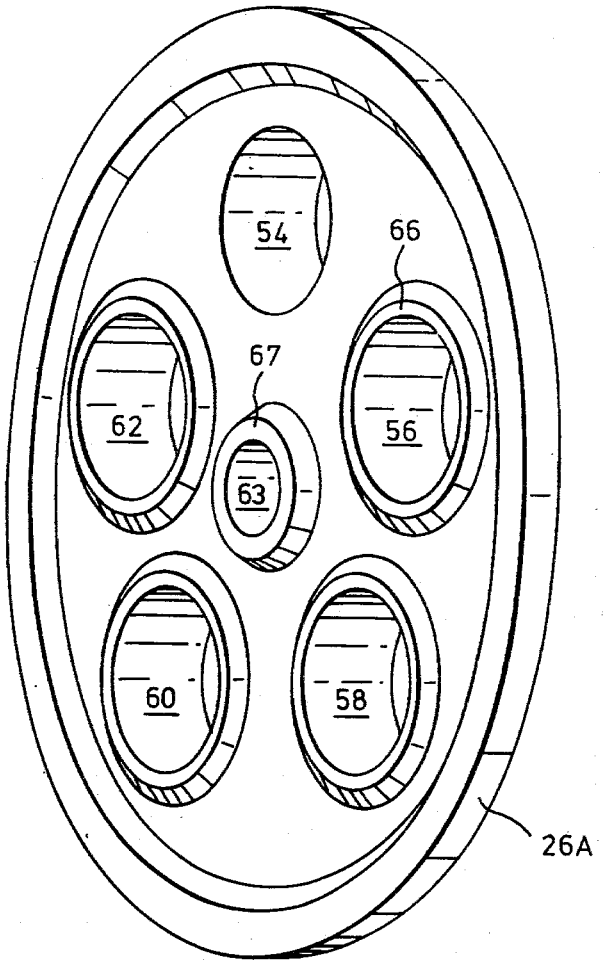
FIG. 3 is a perspective view from the lefthand side of the plate of FIG. 2.

The other face of the support plate 26A, as can be seen from FIG. 3, has a boss 66 surrounding each of the apertures 56 to 60, but not the aperture 54. A further boss 67 is provided on this face of the central aperture 63 also. Both of these bosses are tapered, as can be seen from FIG. 3.

Figure 4:
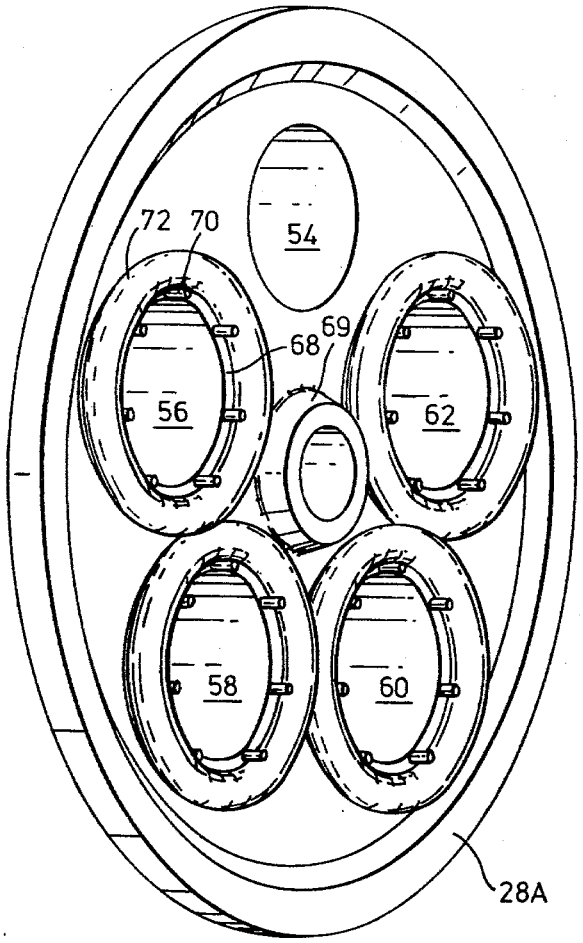
FIG. 4 is a perspective view from the right of the righthand-most second diaphragm support plate of the apparatus of FIG. 1.
Figure 5:
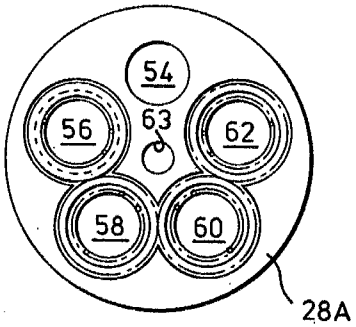
FIGS. 5, 6, 7, 8 and 9 are views from the right of the five second diaphragm support plates.
Figure 6:
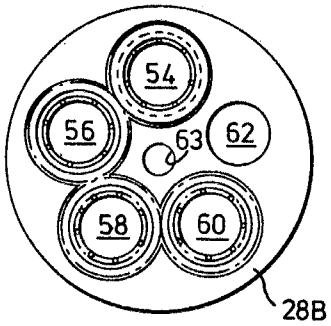
Figure 7:
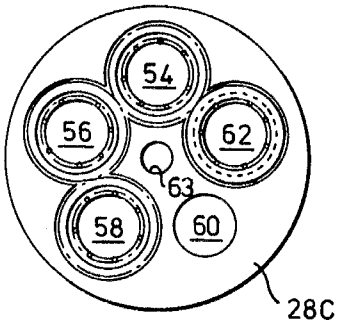
Figure 8:
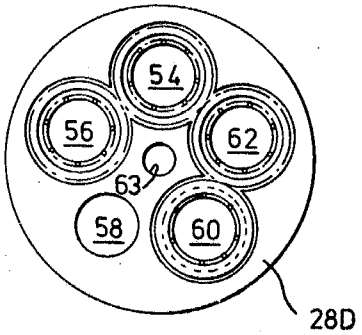
Figure 9:
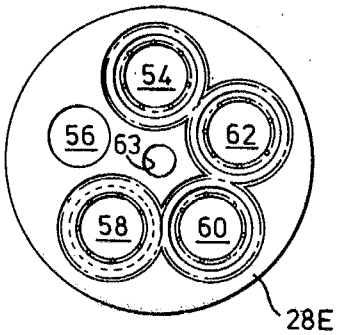

Reference is now made to FIG. 4 where it will be seen that the apertures 56, 58, 60 and 62 of the second diaphragm support plate 28 are also provided with bosses 68 and the central opening with a boss 69.

It will be noted that the aperture 54 does not have a boss 68. The boss 68 of the other four apertures has a number of axially extending rods 70 which act as spacers when the diaphragm support plates are stacked relative to one another. The rods 70 also serve to support O-rings 72 which are in sealing engagement with the tapered surface of boss 68 and with the tapered surface of boss 67 to provide a seal around the adjacent aperture 56, 58, 60 or 62. It will be seen, therefore, that the fluid passage 55 associated with the aligned apertures 54 is fluidtight from one end to the other, except that it is open to the exterior at the location of the hole 54 in the diaphragm support plates 26A and 28A, so that a duct 73 is formed communicating passage 55 with the interior of the toroidal diaphragm 42A.

If reference is now made to FIGS. 5 to 9, it will be seen that with this arrangement, the toroidal diaphragms 42A, 42B, 42C, 42D and 42E are in communication with the passages 55 formed by the aligned apertures 54, 56, 58, 60 and 62 respectively. It would also be seen that the diaphragms are not in communication with more than one such passage, so that discrete chambers 43A, 43B, 43C, 43D and 43E are formed within each diaphragm.

O-rings which are not referenced are provided on the ends of all of the bosses to provide a seal. The end of the passages 55 formed by the various apertures 54 to 62 are blocked because the end support plate 26A has a boss associated with each aperture, and this boss and its associated O-ring (not shown in FIG. 2) is in sealing engagement with the inlet end plate 36.

Figure 10:
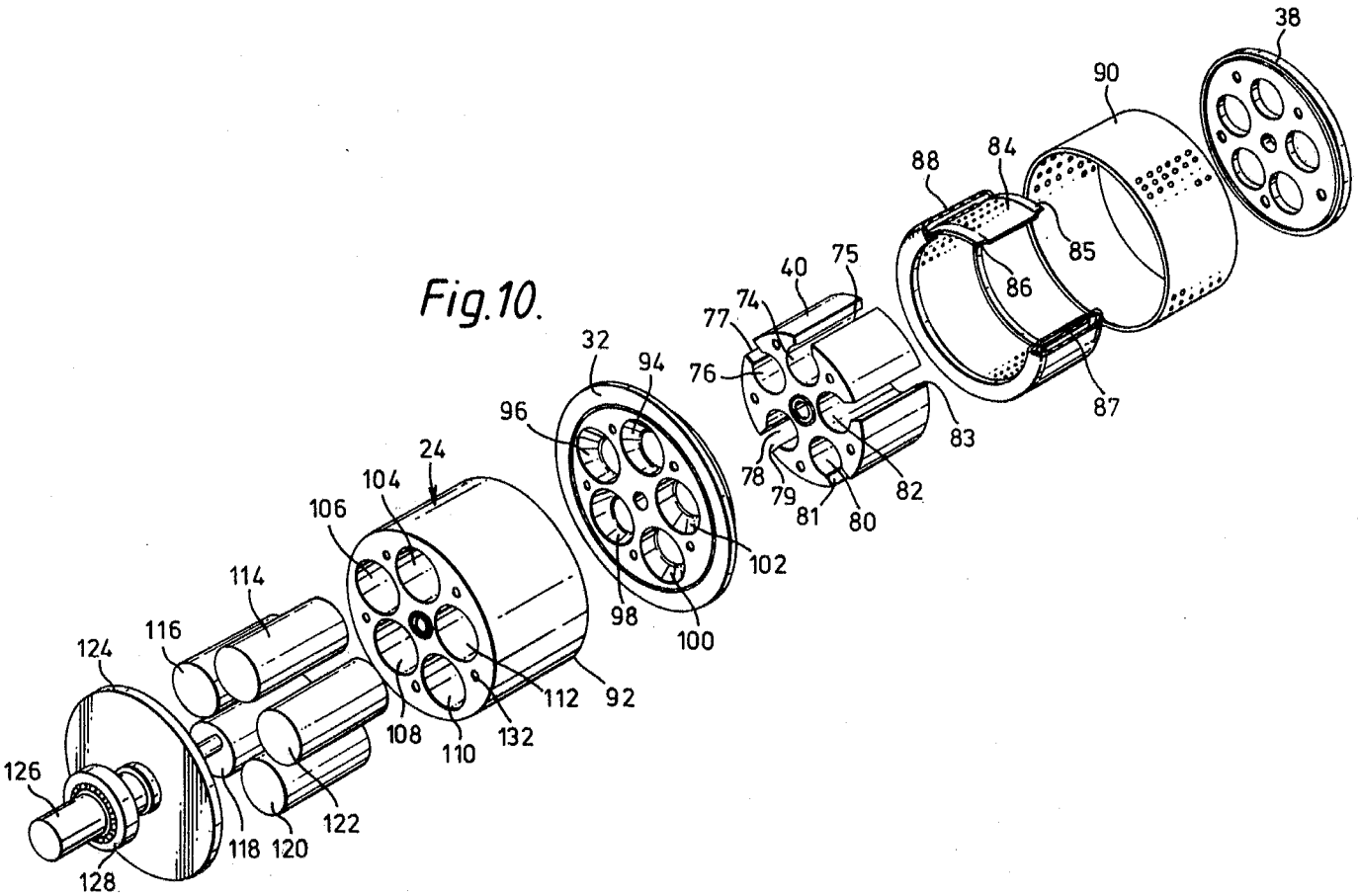
FIG. 10 is a perspective exploded view of the interface unit and pressurizing section of the apparatus of FIG. 1.

The interface unit 22 includes the core 40 (FIG. 10) and five bores 74, 76, 78, 80 and 82 aligned with the passages 55 formed by the apertures 54, 56, 58, 60 and 62 respectively. Each of these bores has a radial slot 75, 77, 79, 81 and 83 respectively. This is surrounded by an annular grid 84 which has outwardly extending enlargements 85 and 86 which grip the ends of an annular reservoir diaphragm 88. This in turn is surrounded by an annular grill 90. A pretensioned resilient valve band 87 surrounds grid 84.

The bulkhead 32 is provided with five equi-angularly spaced tapered holes 94, 96, 98, 100 and 102 axially aligned with the bores 74 to 82 respectively.

The wider end of these holes are aligned with cylinders 104, 106, 108, 110 and 112 respectively, formed in a cylinder block 92 of the pressurizing section 24. Pistons 114, 116, 118, 120 and 122 are axially reciprocable in these cylinders by means of an angled swashplate 124 carried by a shaft 126 mounted in the bearing 128.

Bolts 130 (FIG. 1) pass through holes 132 in the cylinder block 92 to hold this onto the bulkhead 32.

At the inlet end, an inlet cone 134 is secured to the inlet end plate 36 by means of a small bolt 136 fitted into the head of the assembly bolt 30.

In operation, the five diaphragms 42A to 42E, the ducts 73, the passages 55 formed by the apertures 54 to 62, the bores 74 to 82, the tapered holes 94 to 102 and the cylinders 104 to 112, and the reservoir diaphragm 80 are all filled with an operating hydraulic fluid. It will be appreciated that the pistons 114 to 122 will all be at different axial locations, when the swashplate 124 is rotated by the shaft 126 which is connected to a motor (not shown). The passages 55 will be subjected to a cyclical pressure pattern. In the illustrated construction, the passage 55 formed by the apertures 54 and aligned parts is fully pressurized so that the diaphragms 42A is fully expanded so that it abuts the inner surface of the casing 12. Thus, the piston 114 has just completed its forward stroke to the right in FIG. 1. Piston 116 is approaching this position while the piston 118 associated with the diaphragm 42C is substantially at the other end of its stroke so that the diaphragm 42C is fully contracted. The pistons 120 and 122 will at this time be moving away to the left and although the diaphragm 42E is shown as fully expanded, it is beginning to contract. At any given time there will always be two diaphragms fully expanded so that a quantity of external fluid is entrapped between the body section 20 and the casing 12. The arrangement is such that the fluid is moved leftwardly, as viewed in FIG. 1, by the successive outward pulsating movements of the diaphragms 42A to 42E.

From time to time it may be necessary for the motor to be stopped and at this stage in the proceedings the fluid within the outlet chamber 16 and the outlet pipe and any discharge pipe connected thereto, may be at a substantial static head. There would normally, therefore, be a tendency for this fluid to act upon the diaphragms to push them away from the casing 12. However, the provision of the reservoir within the interface unit prevents this from happening. The grill 90 is perforated, as can be seen from FIG. 1 and FIG. 10, so that the outlet pressure is always applied to the reservoir diaphragm 88 and the annular valve band 87. The hydraulic operating fluid within the system is held at a self-compensating pressure so that, should the motor stop, the pressure within the system is maintained, and the fluid in the reservoir is forced into all of the diaphragms, via apertures, one of which is indicated by the numeral 89 in FIG. 1.

In the event that there is a sudden blockage in the outlet pipe, for example, by a valve being turned off, then the O-rings 72 located between adjacent diaphragm support plates 26, 28 will be capable of expanding. Thus, for each diaphragm, when this condition occurs, the O-rings 72 associated with fluid passages 55 which are under relative positive pressure, will expand, so that the pressurized fluid will be released into those passages which are at a relative negative pressure, and fluid will thus short-circuit internally. A temperature senser is preferably provided to sense any increase in temperature which will thus arise, thereby to indicate the fault condition.

Annular diaphragms are each provided with a reinforcement which is preferably in the form of a large number of circumferentially spaced axially extending fibres, which each extend in their own plane which is radial to the axis of the bolt 30, the ends of the yarns being buried in the beads 43 and 44. These enable the diaphragms to be able to withstand very high pressures and yet still maintain sufficient flexibility for satisfactory operation. The fibres may be inclined slightly to these planes but not at too large an angle otherwise the radial expansion ability would be diminished. Circumferentially extending yarns may also be provided but these should be capable of radial expansion. It is also contemplated that two sets of yarns inclined at a small angle to the axial planes could be provided to form a diamond-shaped criss-cross reinforcement.

The reservoir diaphragm 88 can similarly be formed and the valve band 87 can also have reinforcement.

We claim:

1. A fluid displacement device comprising an outer body member having a passage therethrough with an opening at each end, and an inner member passing through said passage, at least three flexible toroidal diaphragms mounted at axially adjacent locations, the interiors of the diaphragms forming discrete chambers, the diaphragms being disposed one after the other along the axis of the inner member and each being movable separately of the others transversely of the axis of the passage to close off the passage of the respective diaphragm, said inner member including a stack of diaphragm support plates, each plate having means defining a number of apertures therein equal to the number of diaphragms to form that number of fluid passages to the stack, the diaphragms being mounted to extend around the periphery of adjacent support plates, means defining ducts between the chamber formed in each diaphragm and a separate one of said fluid passages, and means to feed through said fluid passages an operating fluid under pressure to, or to receive operating fluid under pressure from said discrete chambers to move said diaphragm transversely of the axis of the body in a sequence to cause displacement of an external fluid axially of the body, or to enable power to be derived from the operating fluid as a result of an external fluid moving axially of the body in contact with said diaphragms.

2. A device as claimed in claim 1, and further comprising, on the adjacent faces of each pair of adjacent plates, axially extending bosses at the location of all but one of the apertures, said bosses abutting to provide a fluid passage, the absence of bosses on one aperture providing the duct communicating the passage associated with that aperture with the chamber formed in the diaphragm clamped between the adjacent pairs of plates.

3. A device as claimed in claim 2, and further comprising a resilient sealing ring surrounding each aperture having a boss and engaging the two adjacent diaphragm support plates, said resilient sealing ring being capable of releasing pressurized operating fluid from each passage into any chamber of lower pressure, effective to provide internal recirculation of the operating fluid in the event of an external overpressure condition.

4. A device as claimed in claim 1, wherein said means for feeding or receiving operating fluid under pressure comprises axial extensions of said fluid passages and pistons axially reciprocable in said axial extensions.

5. A device as claimed in claim 4, and further comprising a swash plate driving said piston.

6. A device as claimed in claim 1 and further comprising an annular reservoir disposed around said fluid passages at a location between said means for feeding or receiving operating fluid pressure and the nearest toroidal diaphragm, said annular reservoir including an annular external diaphragm subject to the high pressure side of fluid relative to said toroidal diaphragm.

7. A device as claimed in claim 6, and further comprising an annular protective grill surrounding said reservoir diaphragm.

8. A device as claimed in claim 6, and further comprising a resilient band located within said reservoir diaphragm and means defining bleed apertures which communicate with the fluid within each fluid passage, whereby said band acts as a valve, the band having a stiffness so that, when the device is used as a pump under normal pumping conditions, the valve is closed, and when the drive to the pump is stopped, the operating fluid flows via said bleed apertures from the reservoir to the passages, and when the drive is re-started said band expands suddenly to allow operating fluid to flow back into the reservoir.

9. A device as claimed in claim 6 and further comprising a perforated support grid mounted within said band.

* * * * *